United States Patent [19]

Jentry

[11] Patent Number: 4,682,561

[45] Date of Patent: Jul. 28, 1987

[54] QUICK ATTACH AND RELEASE BASE

[76] Inventor: Danny R. Jentry, 12373 Third St., SE., Fort Myers, Fla. 33905

[21] Appl. No.: 745,062

[22] Filed: Jun. 17, 1985

[51] Int. Cl.[4] ..... B63B 17/00

[52] U.S. Cl. ..... 114/363; 297/252; 297/349

[58] Field of Search ..... 114/363, 188, 194; 248/410, 425, 429, 430; 297/230, 252, 256, 349, 363

[56] References Cited

U.S. PATENT DOCUMENTS

| | | | |
|---|---|---|---|
| 2,204,218 | 6/1940 | Hill | 297/349 |
| 3,789,444 | 2/1974 | McCord | 114/363 |
| 3,821,825 | 7/1974 | Bailey | 114/363 |
| 4,122,571 | 10/1978 | Moeser | 114/363 |

*Primary Examiner*—Jeffrey V. Nase
*Assistant Examiner*—Jesûs D. Sotelo
*Attorney, Agent, or Firm*—Alfred E. Wilson

[57] ABSTRACT

A quick clamp and disengage mechanism for a swivel type seat for small boats. A base having spaced guideways is adapted to be secured to the thwart or seat board extending transversely in a boat. The swivel type seat has parallel sides adapted to slide into the guideways of the base and to be clamped therein by an actuating arm pivoted to the front adjacent one of the spaced guideways, and adapted to pivot across to lie in front of the swivel type seat, and to be clamped in the other of the spaced guideways to hold the seat securely locked in the base. The actuating arm has a handle which may be grasped and moved to release the clamp and to open the guideways to permit the swivel type seat to be released from the spaced guideways.

1 Claim, 8 Drawing Figures

QUICK ATTACH AND RELEASE BASE

BACKGROUND OF THE INVENTION

In many instances, such for exampe as in small fishing boats and canoes, no provision is made for comfortable seats having supporting backs. It is therefore common practice for the passengers to sit on the thwart boards extending transversely of the boat and needed to clamp spaced sides of the boat together, and to strengthen and rigidify the boat. Such flat horizontal thwart boards become very uncomfortable in a short time.

Many efforts have been made to provide a comfortable seat that can be installed and used as needed. To be commercially acceptable, such seats should be readily removable because small boats and canoes are frequently moved on trailers or car tops, and the seats would be an obstruction if they could not readily be removed. Also, there is the danger of theft of such seats if left in place on the boat while the boat is unattended.

FIELD OF THE INVENTION

Broadly stated the object of this invention is to provide a comfortable seat, preferably having a hinged back support, which can be positioned quickly for use in a small boat, such as a fishing boat or canoe, and which can readily be removed so as not to interfere with the loading of the boat to move it over land.

SUMMARY OF THE INVENTION

With my improved seat I secure thin base members having laterally spaced guideways to the thwart boards of the boat. These base members are substantially flat, and they have laterally spaced parallel guideways. These guideways are adapted to receive swivel type seats having spaced parallel lower support members adapted to slide into the guideways and to be clamped therein, and having upper swivel type seat members which, if desired, can have paded seats and folding back rests.

BRIEF DESCRIPTION OF THE DRAWINGS

Referring now to the drawings, wherein similar reference characters refer to similar parts throughout the several views.

DESCRIPTION OF THE PREFERRED EMBODIMENT

Figure 6:
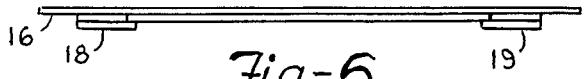
FIG. 6 is an elevational view taken substantially on the line 6—6 of FIG. 4, looking in the direction of the arrows.
Figure 7:
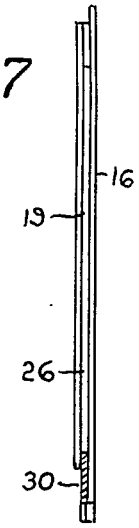
FIG. 7 is an elevational view taken on the line 7—7 of FIG. 4, looking in the direction of the arrows.
Figure 5:
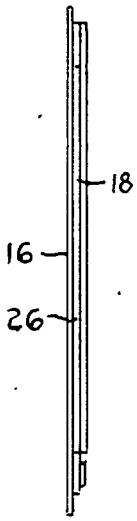
FIG. 5 is an elevational view taken substantially on the line 5—5 of FIG. 4, looking in the direction of the arrows.
Figure 4:
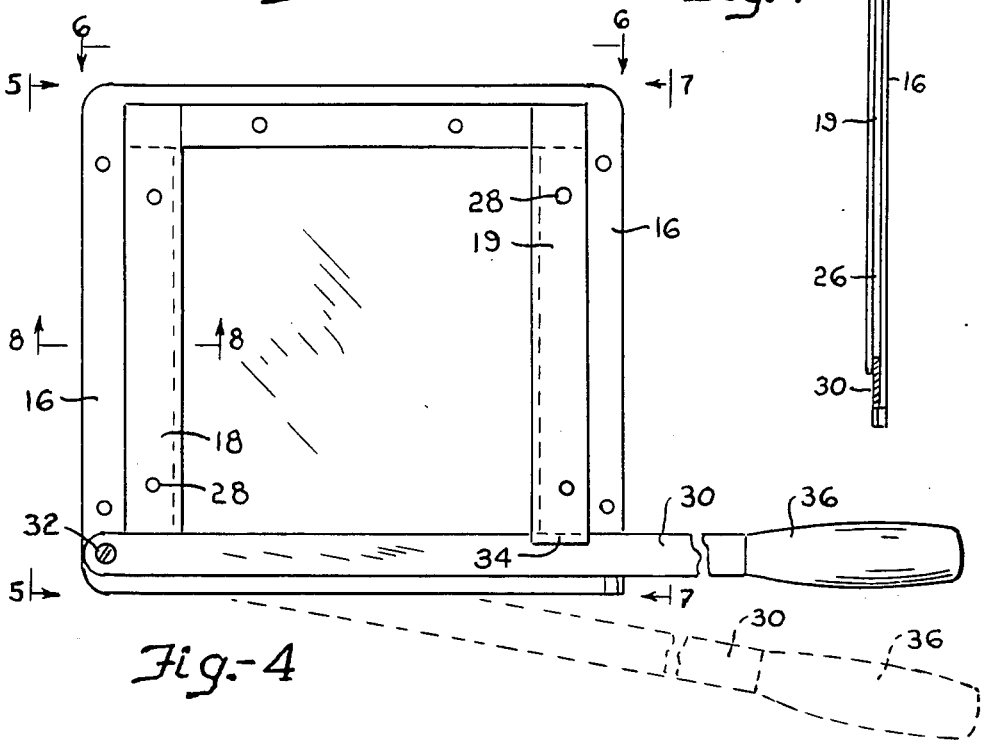
FIG. 4 is plan view of the lower seat support member.
Figure 3:
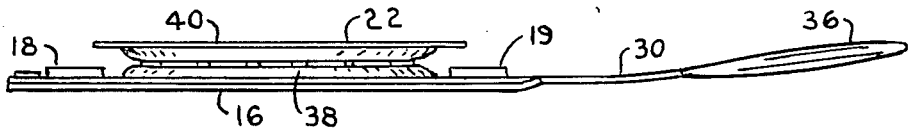
FIG. 3 is a side elevational view of the seat swivelling and clamping mechanism.
Figure 8:
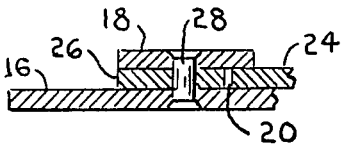
FIG. 8 is a fragmentary sectional view taken substantially on the line 8—8 of FIG. 4, looking in the direction of the arrows.
Figure 1:
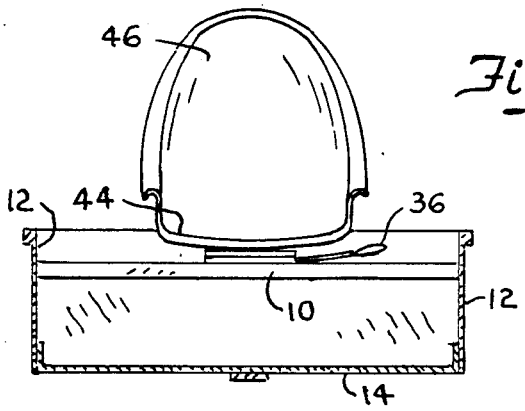
FIG. 1 is a front elevational view of a seat embodying my invention.
Figure 2:
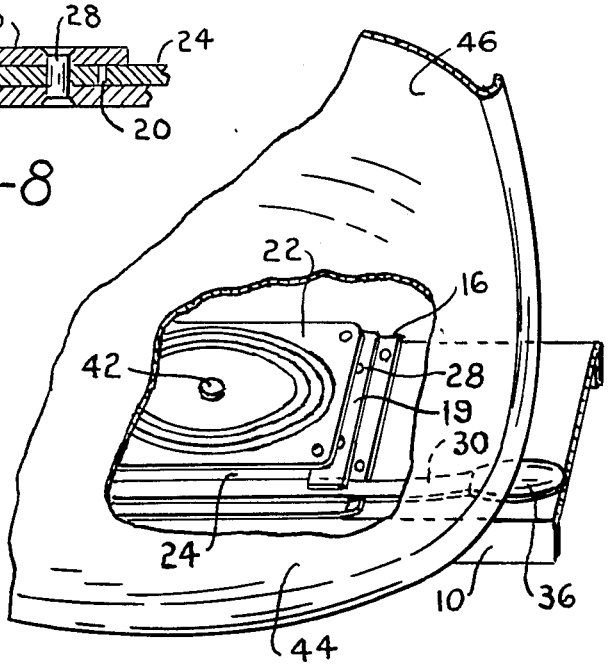
FIG. 2 is a fragmentary perspective view illustrating the swivelling and clamping mechanism of the invention.

Referring now to the drawings, and particularly to FIG. 1, a thwart or transverse board member 10 is provided to interconnect and rigidify the laterally spaced sides 12 of a boat having a bottom 14. While the invention has been illustrated as applied to a square bottomed boat, it will be understood that it can equally well be applied to a boat having a rounded bottom or to a canoe.

A thin base member 16 having spaced apart parallel guideways 18 and 19 provide a slot 20 into which an upper seat support member 22 slides. The upper seat support member 22 has a rectangular or square support member 24 adapted to slide into the slot 20 formed between the lower thin base member 16 and the guideways 18 and 19 secured to the lower thin base member 16 in any convenient manner.

A quick lock and release arm 30 is pivotally mounted at one end to the base member 16 by a rivet 32. The arm 30 when moved outwardly uncovers the entrance to the slot 20 so that the upper seat suport member 24 can readily be slid thereinto. When the member 24 is in the slot 20 the arm 30 can be pivoted in the counter-clockwise direction about the rivet 32 which forms the pivot for the arm 30 to close the entrance of the slot 20. The outer end of the lock and release arm 30 is clampingly engaged and held by the angularly related outer end 34 of the guideway 19. The arm 30 extends beyond the guideway 19, and has a handle 36 which the arm 30 can readily be grasped to move it to open or close the slot 20 to clamp the upper seat support member 24 in the slot 20 or to open the slot 20 so that the seat support member 24 can readily be released and removed from the slot 20.

The upper stationary seat support member 24 has a lower non-rotatable circular turntable support member 38, and a circular upper rotatable turntable 40 rotatably mounted on the non-rotatable circular turntable support member 38 and pivotally mounted thereon for rotation relative thereto by a pivot 42.

A seat 44 which may, if desired, be contured as illustrated at 46 in FIG. 1 to conform with the contours of the human body is secured to the upper rotatable turntable 40. If desired, and other type of rotatable seat such for example as a padded seat and a hinged backrest may be secured to the upper rotatable turntable member.

It will be noted that a comfortable seat may thus be readily secured to the thwart or transverse board member 10 of a boat or canoe. If desired, the seat can readily be removed by merely rotating the lock and release arm 30 in the clockwise direction to uncover the front opening of the slot 20 whereupon the upper seat support member 24 and the turntable assembly members 38 and 40 may be removed from the slot 20 whereupon the boat or other device can readily be loaded in any desired manner because the thin base member 16 does not interfere with the loading or carrying of the boat or other object in which the comfortable seat is positioned.

I claim:

1. A seat for a boat of the fishing and canoe classes having spaced side walls, a thwart board connecting the side walls of the boat, a quick attach and release base comprising a thin base member adapted to be secured to the thwart board, spaced parallel guides secured to the base member and providing an open ended slot, an upper seat support member adapted to slidably project into the open ended slot, a pivoted lock and release arm adapted to overlie the open end of the slot to releasably clamp the seat support member in the slot, a handle to manipulate the lock and release arm, a non-rotatable turntable support member clampingly engaged to the seat support member, a rotatable turntable engaging the non-rotatable support member, a pivot between the non-rotatable support member and the rotatable turntable members, and a seat secured to the rotatable turntable member.

* * * * *